United States Patent [19]

Ogura

[11] 4,062,176

[45] Dec. 13, 1977

[54] HIGH SPEED ROTARY BODY FOR FALSE-TWISTING

[75] Inventor: Junshiro Ogura, Tokyo, Japan

[73] Assignee: Ogura Jewel Industry Co., Ltd., Tokyo, Japan

[21] Appl. No.: 650,079

[22] Filed: Jan. 19, 1976

[30] Foreign Application Priority Data

| | | |
|---|---|---|
| Jan. 27, 1975 | Japan | 50-10434 |
| Mar. 6, 1975 | Japan | 50-27521 |

[51] Int. Cl.[2] ..... D02G 1/06

[52] U.S. Cl. ..... 57/77.3; 57/100; 318/221 E

[58] Field of Search ..... 57/77.3, 77.37, 100; 318/221 E

[56] References Cited

U.S. PATENT DOCUMENTS

| | | | |
|---|---|---|---|
| 3,180,074 | 4/1965 | Smith | 57/77.33 X |
| 3,778,991 | 12/1973 | Brummer | 57/77.3 |

*Primary Examiner*—Richard C. Queisser
*Assistant Examiner*—Charles Gorenstein

[57] ABSTRACT

A high speed rotary body for false-twisting comprising a tubular body in the hollow portion of which a pin element is perpendicularly fixed. The yarn to be crimped is fed into the hollow portion, looped with one turn around the pin element and delivered to a take-up bobbin. The pin element is integrally formed with three portions i.e. a smaller cylinder, a larger cylinder at one of the ends of the smaller cylinder and a truncated control portion at the other end thereof. The intersection of the smaller and larger cylinders forms a step. When the incoming yarn portion precedes to touch the step, this portion occupies the center of the tubular body so as not to balloon during the crimping operation.

8 Claims, 7 Drawing Figures

HIGH SPEED ROTARY BODY FOR FALSE-TWISTING

BACKGROUND OF THE INVENTION

This invention relates to a high speed rotary body for false-twisting, and more particularly, to the high speed rotary body for false-twisting in order to crimp synthetic fiber yarn.

Heretofore a high speed rotary body for false-twisting has been utilized for the purpose of crimping synthetic fiber yarn.

The conventional rotary body, comprises a circular tube revolving at high speed around its axis, and a pin or a peg fixed in the hollow part thereof, in order to impart false twist to a heated synthetic fiber yarn. When the yarn leaves the tube, as the result of heating done previously to the twisting, the fibres retain the distortions imposed on them by the false twist. The heated fiber passes with one turn around the pin and leaves the hollow path of the rotary body through the outlet end thereof. As the tube rotates, the fiber wound around the pin is false-twisted and when it leaves the tube, it is untwisted, and imposed with crimps thereon.

In this case, the yarn is required to be exactly on the center line of the tube when it touches the pin as the tube rotates at a high speed. If the fiber takes a course away from the center of the pin along its axis, the centrifugal force will cause the yarn to undergo a ballooning phenomenon before and after passing through the tube.

The amplitude of ballooning tends to grow larger as the speed of rotation increases. Such ballooning degrades the yarn and makes it fluffy.

Moreover, the yarn tends to break on account of the friction between neighboring fibers when the yarn shifts along the pin. in order to remedy these problems, a pin with a hyperboloid recess in its waist has been utilized, with its diameter decreasing slowly towards its longitudinal center. The pin is eccentrically placed so that when the yarn is fed into the tube through the center line of rotation, it touches the pin at its waist. This construction serves, to some degree, to improve the operative efficiency by spreading the range of speed of twisting without ballooning.

But, in general, as the yarn tension at its feeding side is less than that of delivery side the feeding side portion of the turn of the yarn on the waist of the pin tends to be expelled off the concave portion or the correct center at the rotation, by the stronger yarn tension of the delivery side. Accordingly, ballooning appears again, aided by the centrifugal force, when the speed becomes higher.

An anit-ballooning device having yarn guides with a gutter or tubular form, set in front and back of the rotary body has been proposed. Although it has succeeded in preventing the ballooning outside of the tube, it brings about additional friction on the inner side of the tubular body, causing fluffs and breaking of the yarn.

Such ballooning phenonmenon is not so apparent where the speed of twisting is not high, or the fiber is fine, but, it becomes conspicuous as the twisting speed increases and as the yarn becomes coarser, causing the finished yarn to fluff and break. Accordingly, a rotary tubular body, comprising a pin with a hyperboloid waist, fails to avoid ballooning, fluffing and breaking of the yarn at high speed or by coarse yarn.

SUMMARY OF THE INVENTION

The present invention seeks to overcome the aforesaid defects. The pin is so constructed as to make the center line of the incoming feed yarn coincide with the axis of the rotary body, and at the same time, to prevent the outgoing yarn from forcing the incoming yarn from its original path. There fore an object of the invention is to provide a high speed rotary body having a twist pin, enabling the crimping of yarn at a speed higher than 800,000 rpm without ballooning.

Another object of the invention is to provide a high-speed rotary body having a twist pin, which can crimp polyester synthetic resin fiber yarn at either over-feeding or under-feeding conditions as well.

A further object of the invention is to provide a high speed rotary body which prevents the yarn under crimping treatment from fluffing and breaking.

A still further object of the invention is to provide a method for crimping yarn with high operating efficiency.

With the objects mentioned above in view, a high speed rotary body for false-twisting, is provided comprising a tube rotating around its axis, and a pin element fixed in the hollow portion of the tube perpendicularly to the axis thereof, said pin element having a yarn looping smaller cylinder portion, and at one of the ends of the smaller cylinder portion, a cylinder or square prism with larger dimensions, and at the other end of the smaller cylinder, a truncated cone the apex of which is of the same dimension as said smaller cylinder, arranged to align coaxially and integrally constructed therewith. Furthermore, a step of the pin defined by the intersection of the surfaces of the smaller cylinder and the larger cylinder or prism is so positioned as to make the incoming fed yarn take a correct concentric position with the axis of the rotation of the rotary body, and the length of the smaller cylinder portion is so determined at least as not to cause interference between the incoming yarn and the neighbouring loop of the delivery yarn and at the same time, not to allow the delivery yarn to deviate as far as the conical surface of the pin.

BRIEF DESCRIPTION OF THE DRAWINGS

The foregoing and other objects will appear more fully from the following descriptions referring to the accompanying drawings, in which.

DETAILED DESCRIPTION

Figure 1:
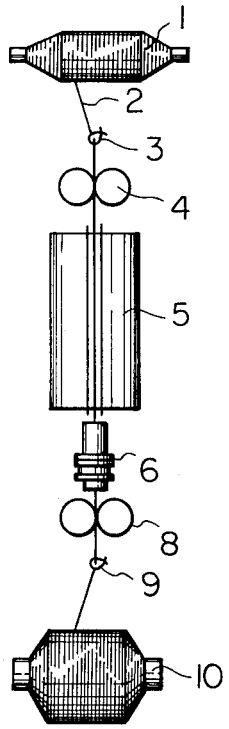
FIG. 1 is a diagrammatic elevational view of yarn crimping apparatus using the rotary body of the present invention.

FIG. 1 illustrates an apparatus for false-twisting yarn, comprising a high speed rotary body 6 serving as a false twister in combination with yarn feed rollers 4, feeding yarn 2 from a rewinding bobbin 1, through a guide 3, a pair of delivery rollers 8, a yarn guide 9, a take-up bobbin 10, and a heater 5 for setting the false twist in the yarn 2 to crimp it.

Figure 2:
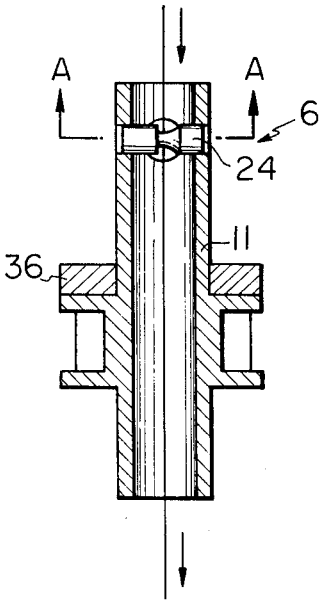
FIG. 2 is a longitudinal section are viewed through the rotary body.

As illustrated in FIG. 2, the rotary body 6 of the present invention includes substantially a tube or tubular body 11 and a twist pin element 24 which is fixed perpendicularly to the axis of the tube 11.

Figure 3:
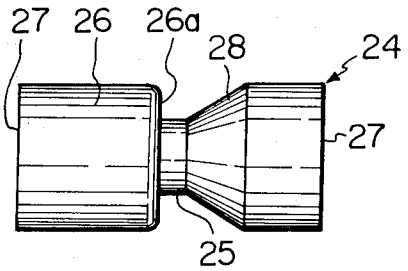
FIG. 3 is a enlarged elevational view of the twist pin element to be fixed to the rotary body of the present invention.

Referring to FIG. 3, the twist pin element 24 includes three major portions i.e., a middle portion 25 which has a cylindrical form of rather small diameter, a larger cylindrical portion 26 which may be of a square prismatic form as well, joined to the portion 25 at one of the ends thereof with a sharp step 26*a*, formed therebetween, and on the other side of the portion 25, a portion 28 formed as a truncated circular cone, the axes of the portions 25, 26 and 28 being aligned with one another.

The pin element may also be constructed by inserting an elongated part of the smaller cylinder 25 into a hole prepared in the center of the larger cylinder 26.

Figure 5:
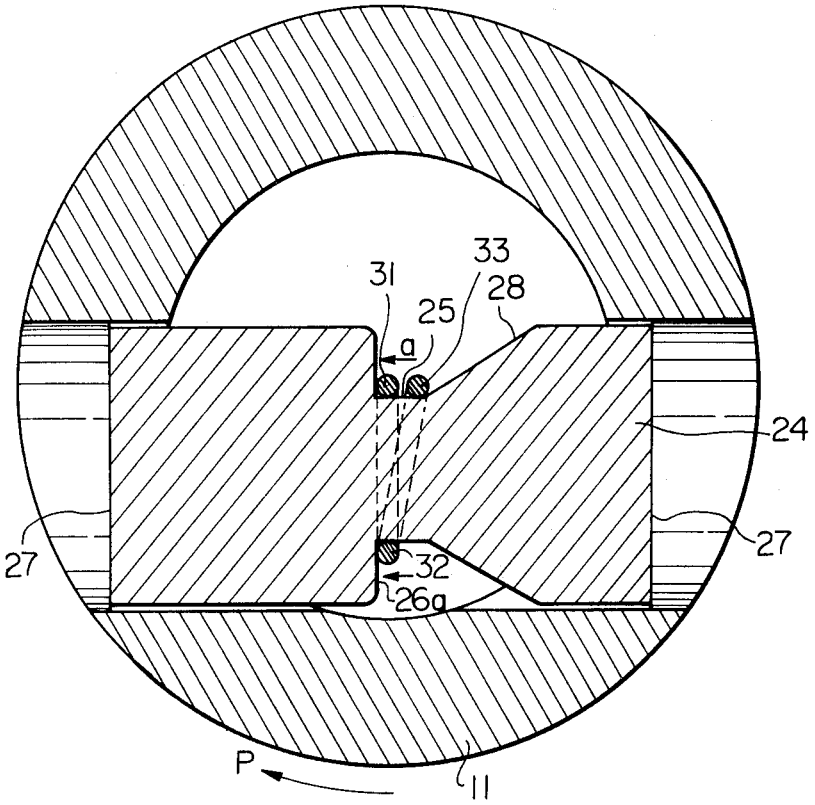
FIG. 5 is a longitudinal sectional view of the pin showing the arrangement of the looped yarn in the process of crimping.
Figure 6:
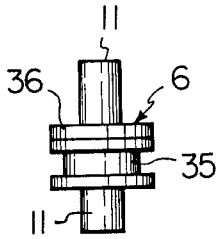
FIG. 6 is an elevational view of the rotary body of the present invention.

The material of the pin element should be hard and sufficiently wear-resistive to withstand high speed rubbing by the yarn, such as sapphire and the like. Both ends of the pin element are formed as fixing shanks 27, whereby, the pin element can be fixed to the rotary body 6 in such a manner, as illustrated in FIG. 2, and 5. The intersection of the step 26*a* and the cylinder 25 is located close to the axis of the rotary body 6, and when the incoming yarn 2 proceeds to touch the pin 24 at the intersection, the yarn center coincides correctly with the center line of the rotary body 6. In FIG. 5, the incoming yarn initially touching said intersection is illustrated at a position 31. FIG. 5 shows the relative location of the pin element 24 with the section of the tube 11 in the hollow space thereof. THe yarn loops around the smaller cylinder 25 through paths shown by 31, 32 and 33 and leaves the twist pin towards the delivery rollers 8.

As illustrated in FIG. 5, the tube 11 rotates at high speed in the direction of arrow P, twisting the feed yarn 31, causing it to have a force to urge itself to the direction at the wall of step 26*a* by its spring back moment of untwisting itself. This tendency serves to prevent the incoming yarn from ballooning. The yarn portion 33 runs side by side with the yarn portion 31.

Figure 4:
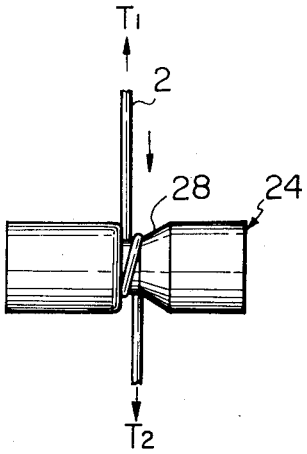
FIG. 4 is a front view showing how the yarn is looped around the pin element.

Centrifugal force will try to expand the yarn portion 33 outward, but the tension $T_2$ as illustrated in FIG. 4 exerted by delivery rollers 8 and cooperating with the untwisting moment of yarn portion 33 itself, will bring the yarn backward, as the result of which, the portion 33 is located on the surface of the cylinder 25 in a stable equilibrium. The effective length of the smaller cylinder 25 is so determined to be no greater than twice the diameter of the yarn to prevent interference between the incoming and delivering yarn portions 31 and 33, and at the same time, to prevent the delivering yarn portion 33 from deviating outside of the portion 25. Under this condition, the yarn portions 31 and 33 get twisted side by side on the surface of the cylinder 25, completing the false twist. As the neighboring yarns remain free from frictional contact with each other, fluffing and yarn breakage do not occur, producing yarn untwisted in an excellent condition.

Insufficient length of the minor cylindrical portion 25 will cause the portions 31 and 33 to make contact with each other, resulting in fluff and breakage on the yarn; excess length of the cylinder 25 will cause the yarn portion 33 to shift along the surface of the cylinder 25, extending on the conical surface of the truncated cone 28, thereby making the location of the portion 33 unstable, and also giving rise to ballooning.

The rotary body prevents ballooning on the feeding side by making the yarn path 31 adhere to the center line of the rotation of the tube or tubular body 11, and at the same time, the delivery yarn 33 is prevented from free displacement along the surface of the minor cylindrical portion 25, whereby the yarn gets free from ballooning on the delivery side of the yarn as well. For that reason the high speed rotary body of the present invention makes it possible to impact false twist and untwist to yarn at a speed higher than 800,000 rpm.

Adoption of the high speed rotary body makes it possible to crimp synthetic fiber yarn, especially polyester resin yarn under conditions of overfeeding or underfeeding.

In the conventional procedure of crimping nylon yarn, underfeeding is generally adopted. If the procedure is effected at overfeeding, more yarn is heated and fed to the twister in a certain unit of time, than that of yarn delivered from it. Accordingly, no draft is given to the yarn between the rotary body 6 and the delivery rollers 8, in this case, heating serving only for false-twisting of said yarn, not for the draft thereof. As known widely, nylon yarn gain its strength by the proper re-arrangement of its molecular orientation attained by drafting after the heating of it.

The same principle applies to polyester yarn. But hithereto, overfeeding crimping has been unsatisfactory because of fluffing and breaking of the yarn at high speed due to ballooning, which disturbs the drafting of the untwisted yarn.

By adoption of the rotary body of the present invention, no ballooning is found either on the feeding side or on delivery side of the yarn, causing no fluffing or breaking thereof. Thus, it becomes possible to crimp polyester fiber yarn by over-feeding or by under-feeding.

In a typical example of the prior art, 150 denier polyester fibre yarn heated to 220° C, is crimped, under a tension of 25g at the feeding rollers, and 50g. at the delivery rollers, and twisted with a rotary body having a twist pin with hyperboloidal profile, giving 2450 twists per meter, at an over-feeding condition, at a revolving speed of the twister of 500,000 rpm., provide 204 m/s of linear yarn speed of production.

In comparison with the performance mentioned above, the same material is heated to the same temperature, and is twisted, by a false twister using the rotary body of the present invention, under a tension of 46g and 64g, at the feeding rollers and the delivery rollers respectively, giving the same value of the twist rate as above, at an under-feeding operation at a speed of 800,000 rpm. and succeded in producing strong yarn with high efficiency at a linear yarn speed of 326 m/s.

As stated above, the process of crimping polyester fiber yarn is operated free from ballooning, and as a result thereof, free from fluffing and breaking of the yarn, whereby yarn productivity has been improved with a higher efficiency of producing crimped yarn with high strength.

The rotatable body may be tubular and may carry a rotor of an air turbine with blades or cups 35 on its periphery into which an air jet can be directed, causing it to turn around its axis. As slight fluctuation in the pressure of the air jet can affect stable rotation of the rotary body, the speed of its rotation is checked strictly.

Figure 7:
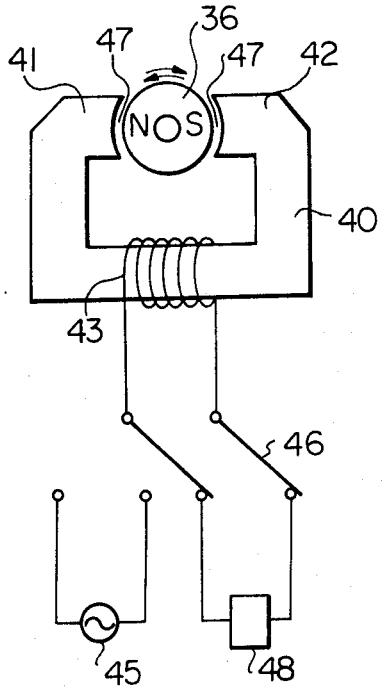
FIG. 7 is a schematic diagram of an electrical circuit in which the speed of the rotary body of the present invention is controlled.

The checking of the rotary body is performed by a ring-shaped permanent magnet 36 fixed to the tubular rotary body, diametrically magnetized and placed between and opposing poles 41, 42 of an electromagnet equipped with a coil 43. At the beginning, and air jet from a compressed air supply, (not shown), is directed against the blades of the turbine 35, causing it to start rotating. Referring to FIG. 7, when the permanent magnet takes the position as illustrated, S polarity will be induced in the pole 41, and N polarity in the pole 42.

Here, the permanent magnet 36, air gap 47, and electromagnet 40 define a closed magnetic path. By the rotation of the permanent magnet, the flux from the permanent magnet passing through the electromagnet interlinks with coil 43 to thereby induce an alternating electromotive force across the coil. This electromotive force becomes a frequency signal corresponding to the revolution of the rotary body. Said frequency signal, when is fed to a control device 48, is utilized for the control of the speed of revolution of said rotary body following the change of revolution of the body.

A control power source 45 serves for producing an amplified constant frequency or pulse to the rotary body to rotate it with a constant speed of revolution. Said amplified frequency is supplied by switching the power over to the coil 43 through a change over switch 46, when the rotary body attains or is about attain to the predetermined revolutional speed. In this case, as the current from the controlled power source 45 is far more intensive than that from the frequency signal generated in the coil 43, the former overpowers the latter, causing the magnetic polarity of the poles 41 and 42 to alternate in correspondence with the current from the source 45. Also the magnet 36 rotates at a speed in synchronism with the frequency of the alternating magnetic flux of the poles 41 and 42 magnetized by the current. Upon commencement of revolution of the rotary body 6 in synchronism with the frequency or pulse amplified by the power from the controlled source 45, the body maintains its rotation in synchronism with the power from the source, so far as the frequency or the pulse rate of the source 45 remains constant.

In the course of pulling the rotary body 6 into synchronism, as mentioned above, it happens occasionally that the procedure is applied in an premature timing, before attaining perfect coincidence of both frequencies. In this case, as the permanent magnet 36 is subjected to a demagnetizing field, until the accomplishment of synchronism, the character of the permanent magnet should posses not only a high degree of its coercive force, but also a strong residual magnetism sufficient to maintain the rotation of the rotary body by overcoming the efect of the magnetic field generated in the air gap 47.

For that purpose, the magnet is required to have a coercive force far stronger than the magnetic intensity of the field generated in the gap 47 by the controlled power from the source 45. Moreover, as the speed of the rotary body increases, the centrifugal force, will exert a destructive power in proportion to the square of the radius which must be overcome by the mechanical strength of the material of the magnet.

Furthermore, in order to overcome the effect of fluctuation of the frequency or power from the controlled source 45, the magnet itself must have sufficient moment of inertia, requiring it to be of large specific gravity.

As the material for the permanent magnet, satisfying those requirements mentioned above, a permanent magnet with a super lattice texture such as a Pt - Co alloy is desirable.

By using electromagnet 40 whose coil is excited by 16.7 KHz of amplified power from a control source 45, the rotary body having an outer diameter of 5 mm with a piece of Pt-Co permanent magnet thereto can reach 1,000,000 rpm and more with satisfactory results of false-twisting the yarn.

Although in the foregoing example the rotary body is synchronized with a magnetic field produced from a single pair of magnetic poles, it is obvious that other embodiments provided with a revolving magnetic field may also be used as well, giving the same merit to said rotary body.

What is claimed is:

1. A rotary body for false twisting yarn comprising a tubular body having an axis and being rotatable around said axis and a pin element in said tubular body fixed perpendicularly to said rotating axis of said tubular body, said pin element comprising a small cylinder portion having an axis, a diameter, and two ends, a larger cylinder portion at one end of said smaller cylinder portion and having a larger diameter than said diameter of said small cylinder portion, and a truncated conical portion having an axis and a truncated end, said truncated end adjoining the other end of said smaller cylinder portion, the diameter of said truncated end being the same as that of said small cylinder portion and said axis of said truncated portion and said small cylinder portion being co-axial.

2. A rotary body as defined in claim 1 further comprising an electromagnet including a coil wound around said electromagnet and a controlled power source to supply alternating electric current to said coil, wherein said tubular body comprises a permanent magnet fixed thereto with its direction of magnetization diametrical thereto, said permanent magnet being driven rotatably by interlinking an alternating magnetic field from said electromagnet associated operatively therewith and induced by said coil.

3. A rotary body as defined in claim 2, wherein said rotary body revolves at a predetermined speed and wherein said permanent magnet generates a magnetic field whose intensity is less than that of the alternating magnetic field excited through said coil when the speed of revolution of the rotary body attains said predetermined speed.

4. A high speed rotary body as defined in claim 2, said permanent magnet being composed of a magnet with super lattice texture.

5. A rotary body as defined in claim 2, further comprising a change over switch and controlling means to be fed with alternating frequency generated in said coil in accordance with the rotation of the rotary body for utilizing said frequency to control the speed of revolution of said rotary body, said controlled power source and controlling means being connected to said coil by means of said change over switch.

6. A rotary body for false twisting yarn as defined in claim 1, wherein said small cylinder portion is partially inserted into said larger cylinder portion.

7. A rotary body for false twisting yarn as defined in claim 1, wherein the small cylinder portion joins the larger cylinder portion and is arranged in said tubular body in such a manner that the joint of said smaller cylinder and said large cylinder portion is offset from said axis of said tubular body by one-half the diameter of the yarn to be false-twisted.

8. A rotary body for false twisting yarn as defined in claim 1, wherein the yarn is fed into and delivered from said tubular body, the effective length of said small cylinder portion being no greater than twice the diameter of the twisted yarn to accommodate only one turn of said yarn thereon while retaining said turn between the ends of said larger cylinder portion and said truncated conical portions thereby to prevent interference between the yarn portions running side by side with each other on said smaller cylinder portion and being formed by the yarn fed into said tubular body and delivered therefrom.

* * * * *